United States Patent [19]

Smith et al.

[11] 4,168,739

[45] Sep. 25, 1979

[54] ROTARY POURING SYSTEM

[75] Inventors: Frank B. Smith, Medford; Wilfred E. Willis, Edgewater Park, both of N.J.

[73] Assignee: Inductotherm Corp., Rancocas, N.J.

[21] Appl. No.: 862,325

[22] Filed: Dec. 20, 1977

[51] Int. Cl.[2] ..... B22D 41/12; B22D 47/00

[52] U.S. Cl. ..... 164/155; 164/323; 164/335

[58] Field of Search ..... 164/155, 323, 335, 336, 164/4, 136; 222/607, 591, 168.5

[56] References Cited

U.S. PATENT DOCUMENTS

| | | | |
|---|---|---|---|
| 1,354,732 | 10/1920 | Disinger | 164/335 X |
| 3,095,620 | 7/1963 | Péras | 164/335 X |
| 3,122,800 | 3/1964 | Naffziger | 164/155 |
| 3,398,782 | 8/1968 | Lauterjung | 164/336 |
| 3,470,941 | 10/1969 | Thompson | 164/133 X |
| 3,537,489 | 11/1970 | Hall | 164/136 X |
| 3,552,902 | 1/1971 | Schöffmann et al. | 222/607 X |
| 3,923,201 | 12/1975 | Hersh et al. | 164/336 X |
| 3,977,461 | 8/1976 | Pol et al. | 164/155 |
| 4,033,403 | 7/1977 | Seaton et al. | 164/155 |

*Primary Examiner*—Othell M. Simpson
*Assistant Examiner*—J. Reed Batten, Jr.
*Attorney, Agent, or Firm*—Seidel, Gonda, Goldhammer & Panitch

[57] ABSTRACT

A plurality of carriages, each containing a pouring ladle, are provided for pouring molten metal into moving molds of a conveyor. The carriages are essentially driven from a single motor and move in a closed loop containing a loading zone and a pouring zone. Each carriage contains a clutch pump and a brake pump to control movement along the loop. Rotation of ladles to a pour position is attained by use of a parallelogram linkage on the carriage and remotely located variable pour rate controls.

16 Claims, 17 Drawing Figures

195
200
34
202
204
190
192
174
194
196
188
198
184
186
178
176
180
172
173
170
168
171
166
102
6

FIG. 7
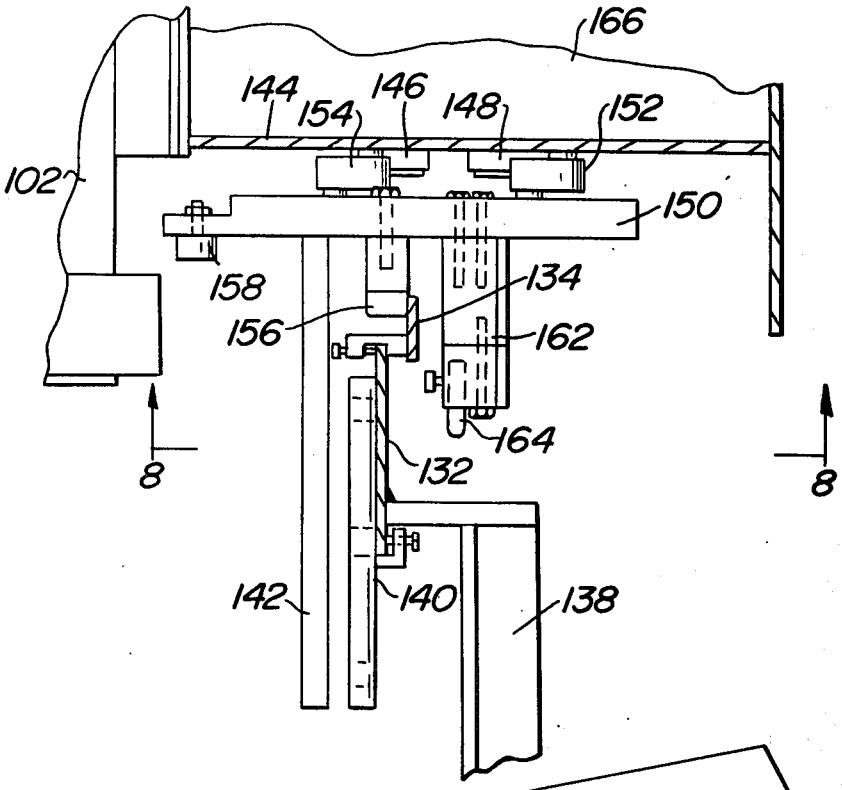
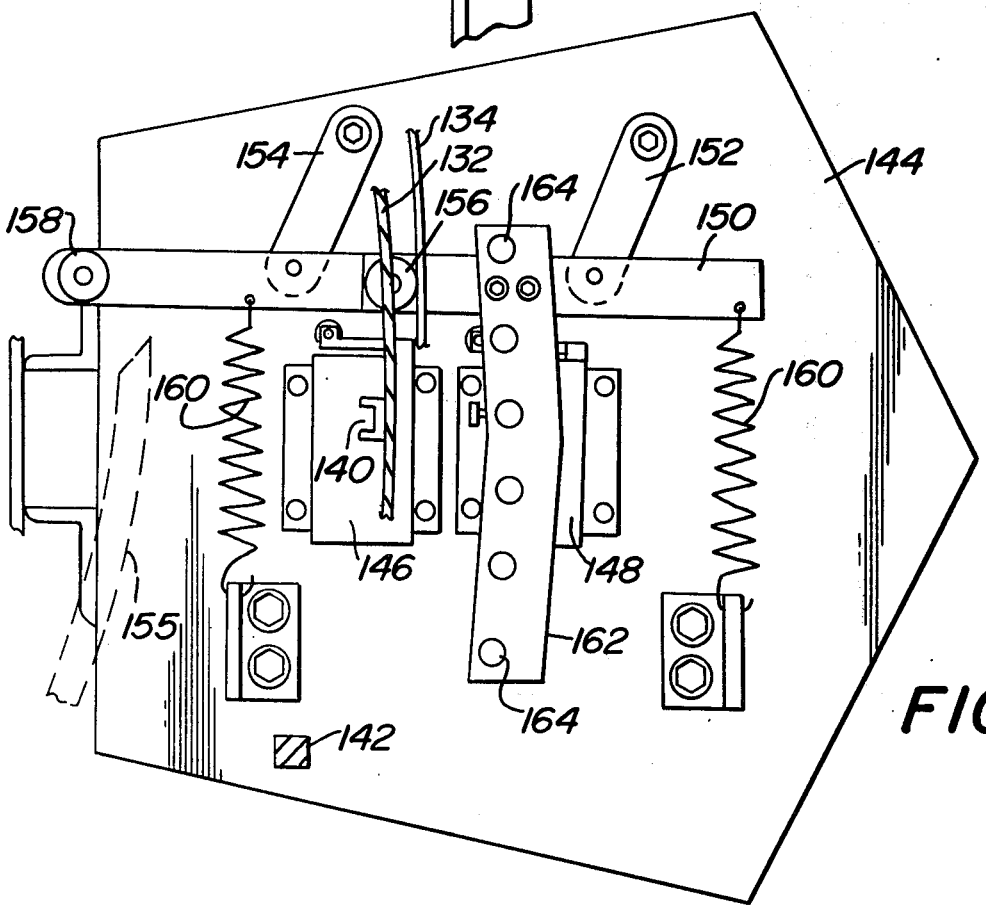
FIG. 8

FIG. 9
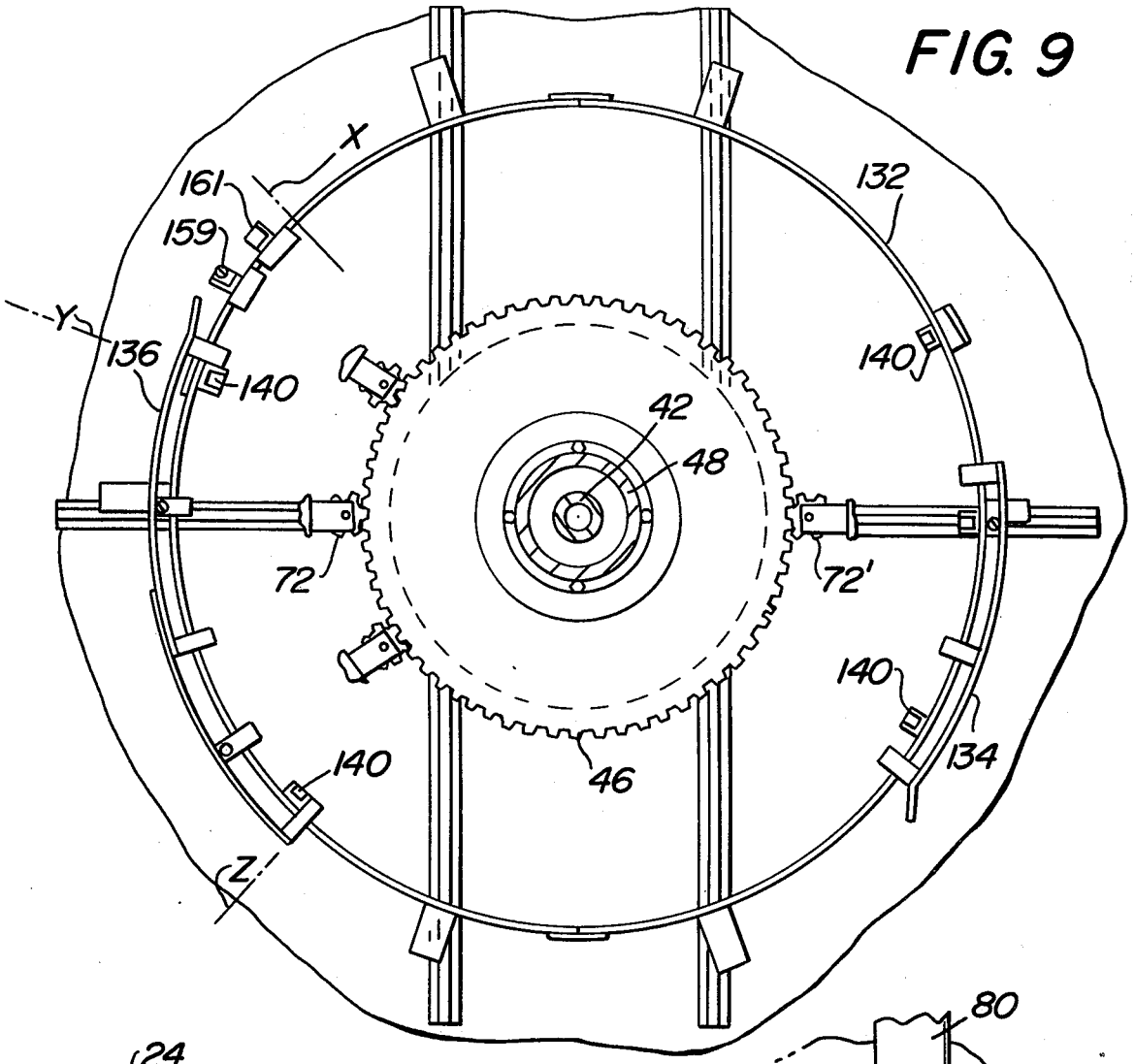
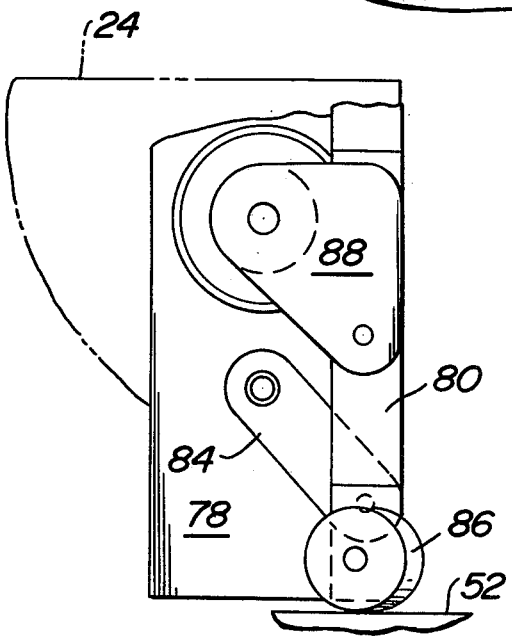
FIG. 11
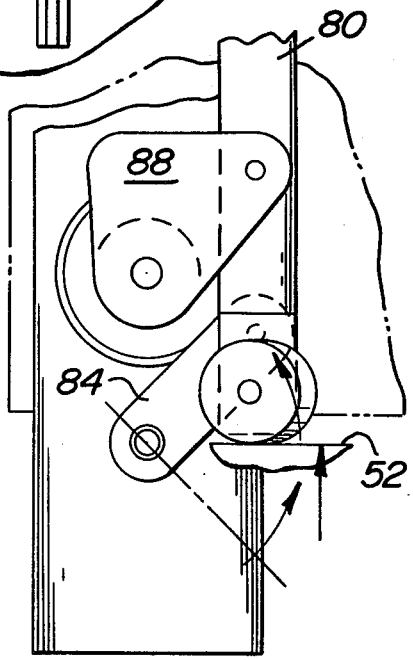
FIG. 12

UPPER ARM
HYD. CONTROLS
UPPER ARM HYD. VALVING
SLOW SPEED VALVES
STOP VALVES
CLUTCH PUMP
ARM HYD. TANK
OIL LEVEL
288
260
264
258
252
254
249
290
292
246
278
240
296
256
266
294
68'
70'
113
114
112
123
124
122

ROTARY POURING SYSTEM

BACKGROUND

The present invention is directed to a rotary pouring system which is an improvement over that disclosed in U.S. Pat. No. 3,977,461. The present invention eliminates various disadvantages disclosed in the system of said patent and has additional features as will be set forth hereinafter. Some of the disadvantages are the inability to continuously change the pouring rate, the need for a separate drive motor on each moving carriage thereby requiring complex rotary connections, the use of air motors which require air compressor, inability to quickly change from one pouring curve to another, inability to continuously vary the pouring rate within a pouring curve, the need to modify mold cars to achieve mold tracking, the inability to rapidly accelerate and decelerate the carriages thereby increasing the dead time moving from pouring zone to loading zone and back again, etc.

SUMMARY OF THE INVENTION

The present invention is directed to a rotary pouring system having a plurality of carriages. Each of the carriages supports a ladle rotatable between a fill position and a pour position. The carriages are guided for movement in a closed loop adjacent a loading zone where ladles are filled and a pouring zone where ladles are rotated to their pour position for pouring molten metal into molds.

The rotary pouring system includes a common drive means for driving said carriages. A sensor means is supported by each carriage for sensing the presence of a mold and for causing the carriage to match the mold speed. A clutch means and a brake means alternatively couple each carriage to said common drive means.

Various advantages of the present invention over the system disclosed in said patent include the ability to continuously vary the metal pouring rate during the mold filling operation so as to faithfully reproduce the optimum pouring curve for the particular mold being poured. Pouring curves can be quickly changed when mold patterns are changed. Automatic preheating of refractory in pouring ladles is provided before production runs and/or during unscheduled line stoppages. The system is simpler and more reliable so as to reduce downtime and maintenance.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 7 is an enlarged detail view of the lower right-hand corner of the apparatus in FIG. 1.

FIG. 8 is a sectional view taken along the line 8—8 in FIG. 7.

FIG. 9 is a sectional view taken along the line 9—9 in FIG. 1.

FIG. 11 is an enlarged detail view of a part of the parallelogram showing linkage in the fill position of a ladle.

FIG. 12 is a view similar to FIG. 11 but showing the linkage in the pour position of the ladle.

Figure 14A:
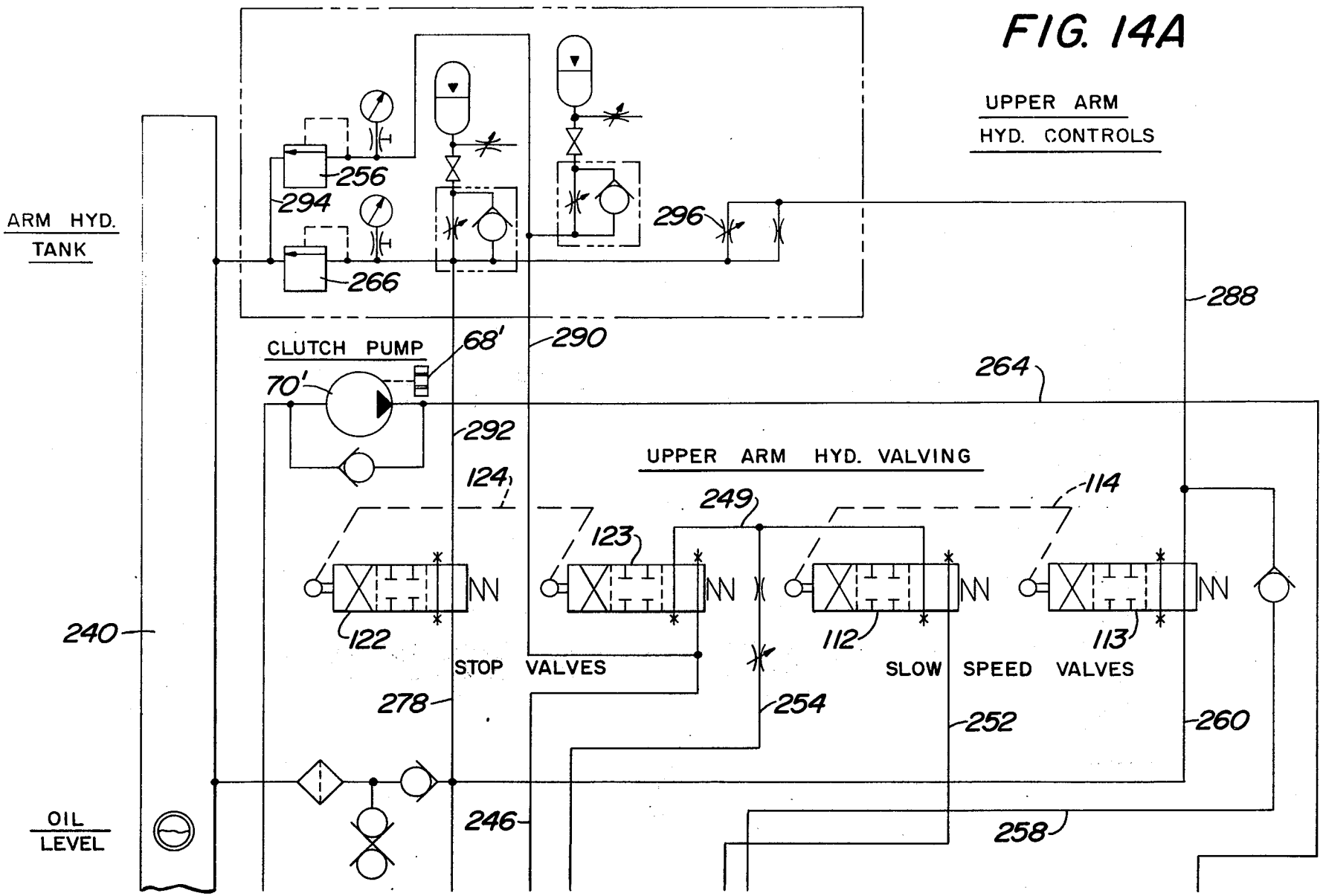
Figure 14B:
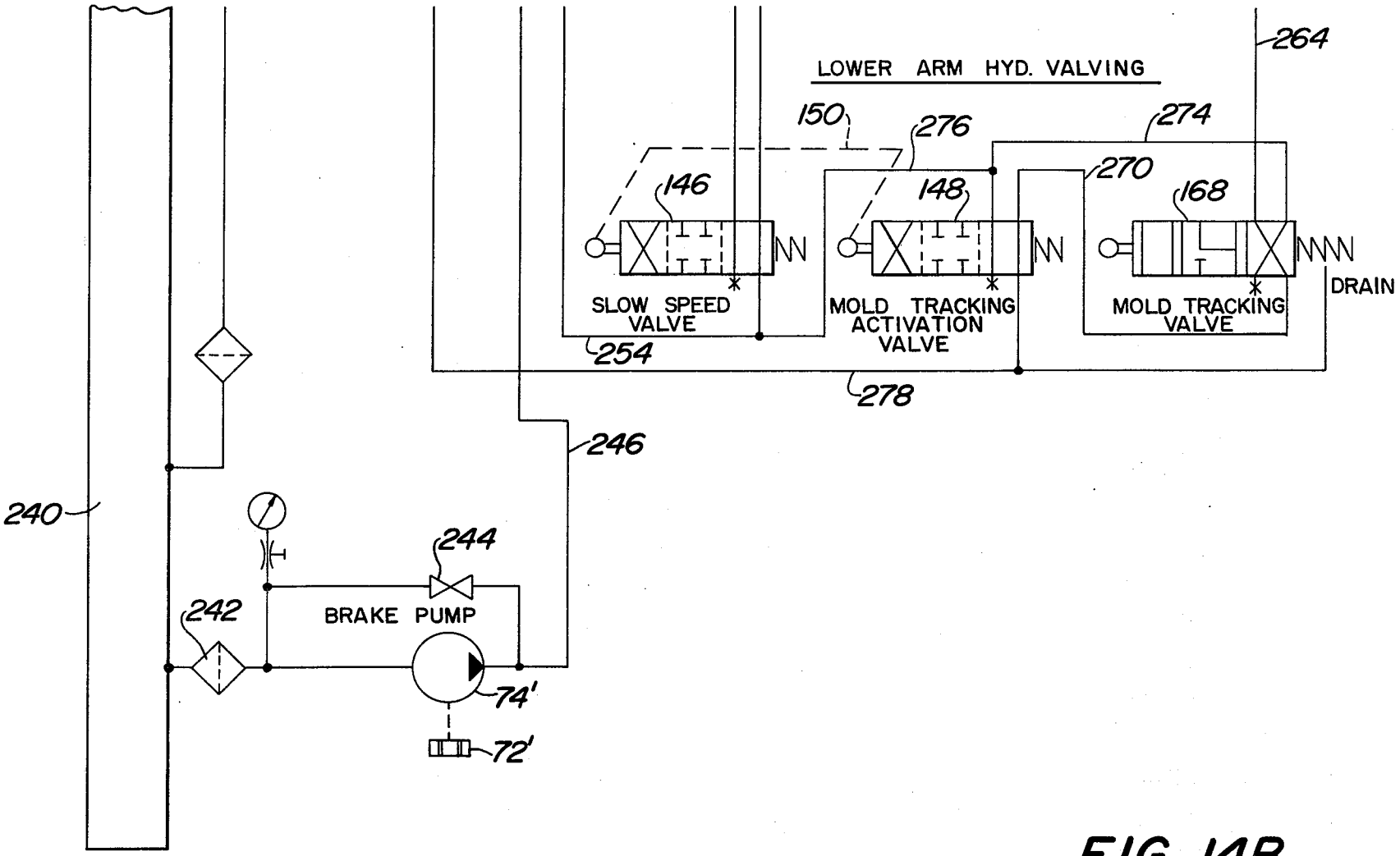

FIGS. 14A and 14B contain a diagrammatic hydraulic system for a single carriage.

Figure 15:
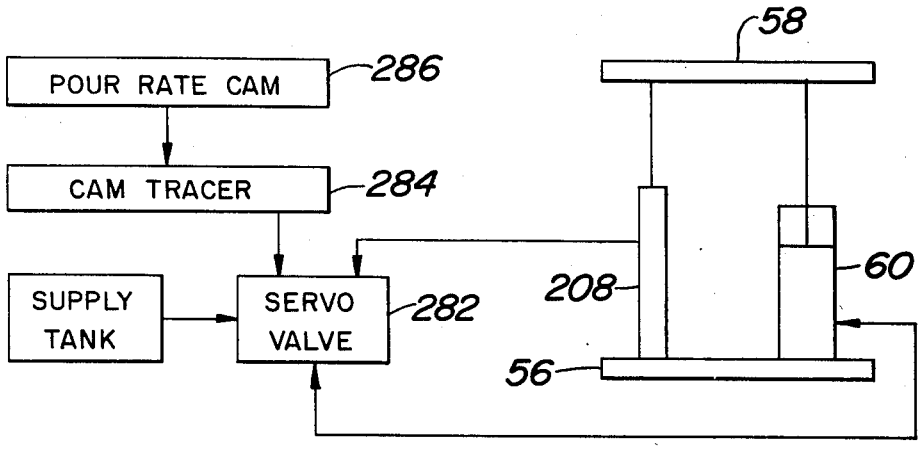

FIG. 15 is a simplified schematic diagram illustrating the relationship of components for controlling the pouring rate of a ladle.

Figure 16:
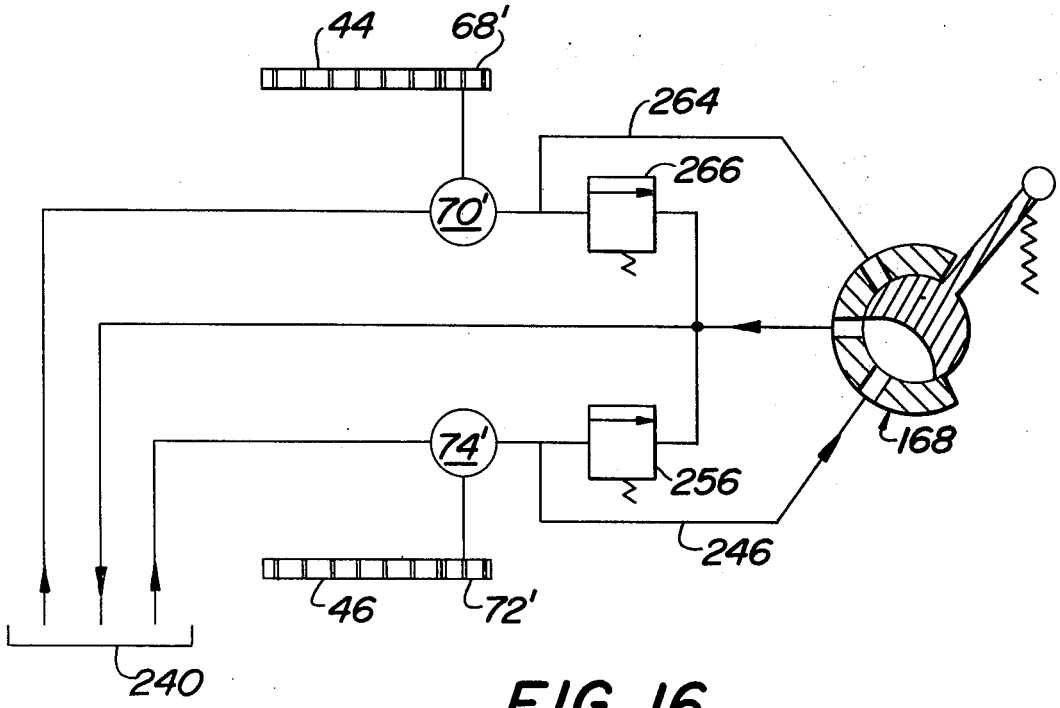

FIG. 16 is a simplified hydraulic schematic of the diagram in FIG. 14.

Referring to the drawings in detail, wherein like numerals indicate like elements, there is shown a rotary pouring system in accordance with the present invention designated generally as 10. The system 10 includes for purposes of illustration four carriages designated 12, 14, 16 and 18. A greater or lesser number of carriages may be provided as desired.

Figure 1:
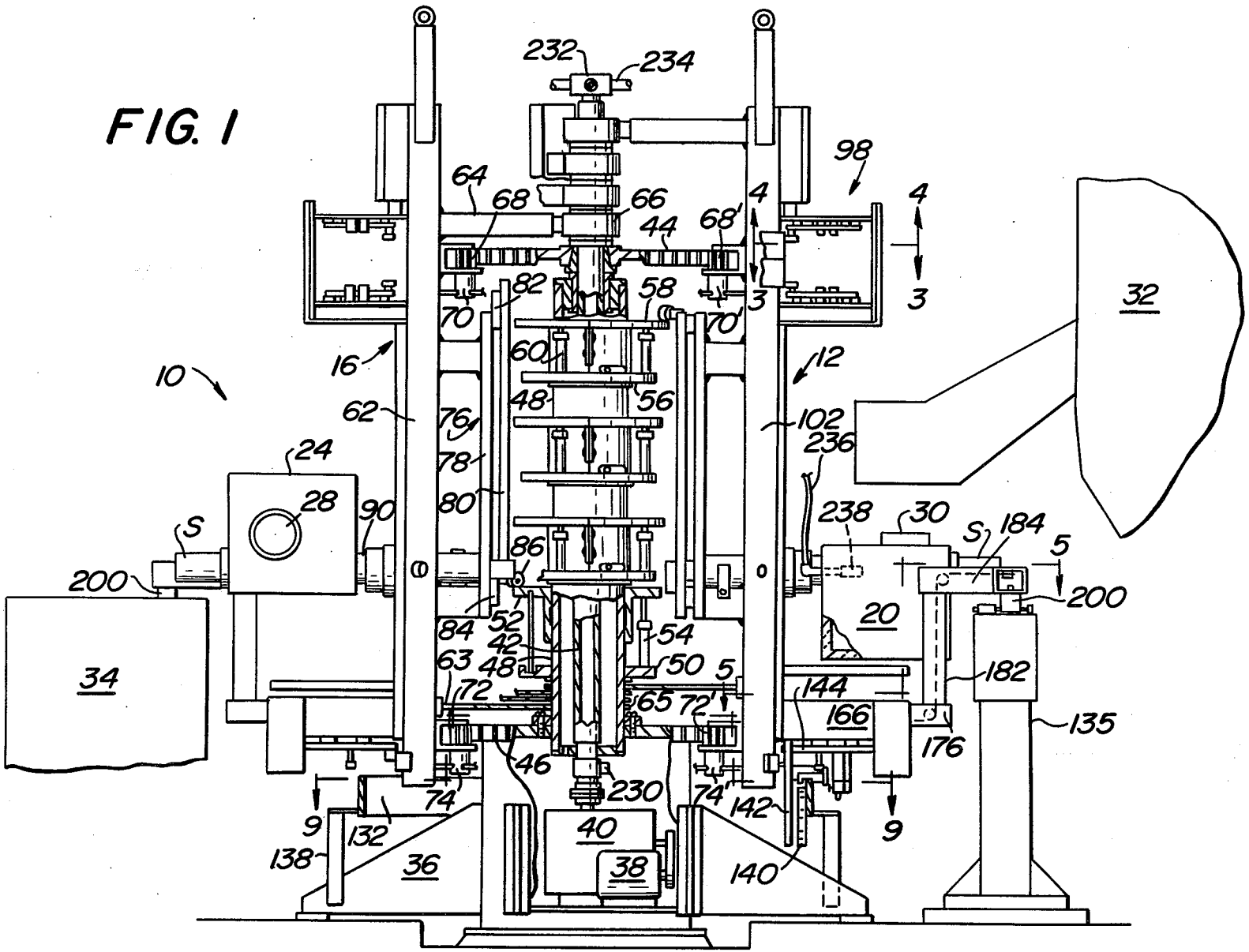
FIG. 1 is a vertical sectional view through the apparatus of the present invention with portions shown in section.

The carriages 12, 14, 16 and 18 are respectfully provided with ladles 20, 22, 24 and 26. Each ladle has a fill port and a spout designated S for discharge of molten metal from the ladles. Referring to FIG. 1, the fill port on ladle 24 is designated 28 and the fill port on ladle 20 is designated 30.

Figure 2:
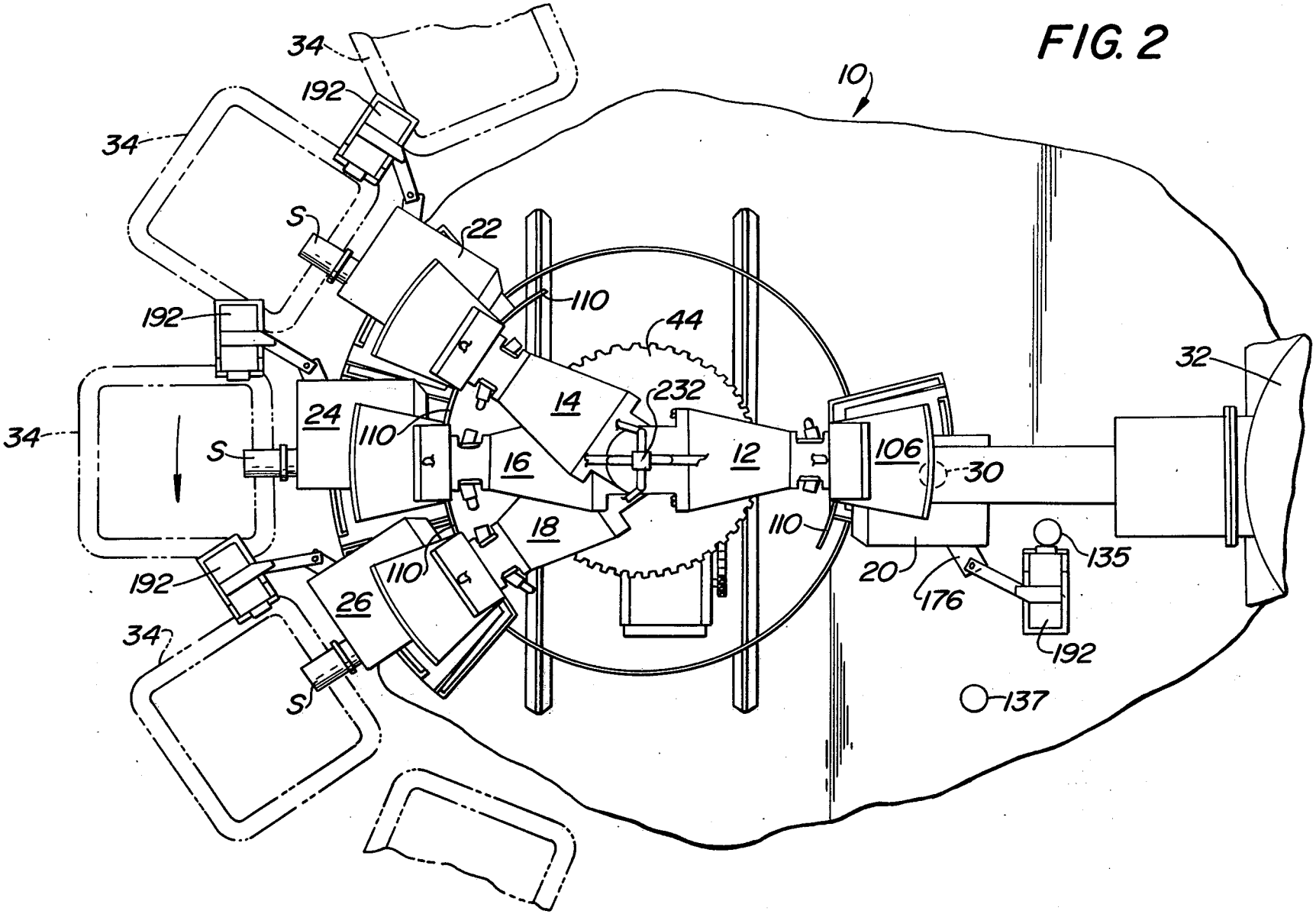
FIG. 2 is a top plan view of the system shown in FIG. 1.

The carriages are supported and driven for rotation through a closed loop. Adjacent the closed loop, there is provided a holding vessel 32 having a large supply of molten metal which is selectively discharged through an entry or fill port on the ladles when they are in a fill position. In FIGS. 1 and 2, the ladle 20 on carriage 12 is in a fill position while the remaining carriages are in a pour position. In the pour position, the ladles are adapted to pour molten metal into a conveyor comprised of molds 34 made of sand or the like. The manner in which the molds 34 are conveyed past the closed loop is conventional and forms no part of the present invention.

The apparatus includes a base 36 on which is supported a motor 38. Motor 38 is connected by way of a gear reducer 40 to a vertically disposed drive shaft 42. The upper end of drive shaft 42 is connected to and drives a large diameter ring gear 44. A similar ring gear 46 is fixed to and stationary with respect to the base 36.

A center column 48 is supported by the stationary base 36 and surrounds the drive shaft 42. Gear 44, gear 46, shaft 42 and center column 48 are coaxial. Column 48 is provided with sets of pour actuators corresponding in number to the number of carriages. Each pour actuator is comprised of a plate fixed to the center column and a movable cam plate. Each cam plate surrounds the center column 48 and is connected to its associated fixed plate by cylinders which are selectively activated from a remote location.

Referring to FIG. 1, plate 50 is fixed to center column 48 and a cam plate 52 is slideably guided by the center column 48. Cylinders 54 are secured to the fixed plate 50. Piston rods extending from the cylinders push up on the lower surface of the cam plate 52. Elements 50, 52 and 54 constitute the pour actuator for ladle 24 on carriage 16. The pour actuator for ladle 20 on carriage 12 includes plate 56 fixed to the center column 48 and cam plate 58 slideably guided by center column 48. See FIGS. 1 and 10. Cylinders 60 are connected to the fixed plate 56. Piston rods extending from the cylinders 60 push up on the lower surface of the cam plate 58.

The carriage 16 includes a vertically disposed post 62 having an arm 64 adjacent its upper end connected to a bearing 66 which surrounds the drive shaft 42 and having an arm 63 adjacent its lower end connected to a bearing 65 which surrounds column 48. Post 62 rotatably supports a pinion 68 meshed with the periphery of gear 44. Clutch pump 70 is driven by a pinion 68. Post 62 also supports a pinion 72 meshed with the gear 46. Brake pump 74 is driven by pinion 72. The pour actuator associated with carriage 16 is coupled to the ladle 24 by way of a parallelogram linkage 76. The linkage 76 includes elongated vertically disposed links 78 and 80. Link 78 is stationary and supported by the post 62. Movable link 80 is pivotably connected to link 78 by short links 82 and 84.

Referring to FIGS. 1, 11 and 12, it will be noted that link 80 rotatably supports a cam follower 86 which rides on the cam plate 52. As cam plate 52 is elevated by the cylinders 54, as shown by comparison of FIGS. 11 and 12, link 80 is elevated. A link 88 is pivotably connected to link 80 intermediate its ends and is also fixedly connected to the support shaft 90 for ladle 24. Hence, when link 80 is raised from the position shown in FIG. 11 to the position shown in FIG. 12, ladle 24 is rotated from its fill position to its pour position.

The other carriages are similarly interrelated with a pour actuator on the center column 48. For example, see FIG. 10 wherein corresponding elements are provided with corresponding primed numerals. The support shaft 90' for the ladle 22 is at the same elevation as that of shaft 90. The cam follower 86' is at an elevation so that it may be actuated by the cam plate 92 associated with fixed plate 94 on the center column 48. The cylinders 96 are shown in activated position in FIG. 10. The links 80, 80' are identical and may be used interchangeably although certain holes in the link will not be used depending upon the particular carriage involved.

Each carriage is provided with a drive interrupter to prevent one carriage from colliding with another. Only the drive interrupter 98 on carriage 12 will be described in detail.

Figure 3:
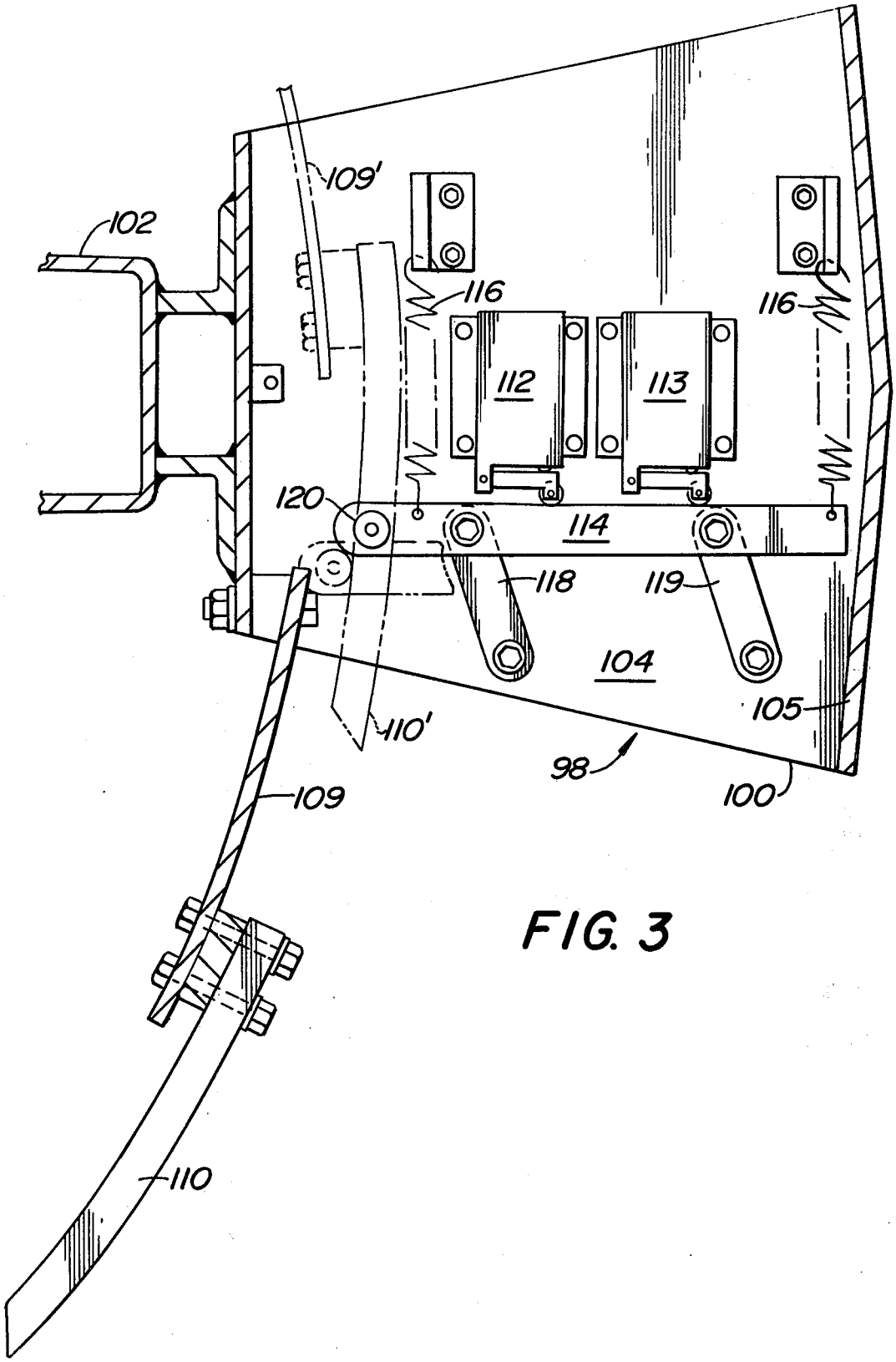
FIG. 3 is a sectional view taken along the line 3—3 in FIG. 1 but on an enlarged scale.
Figure 4:
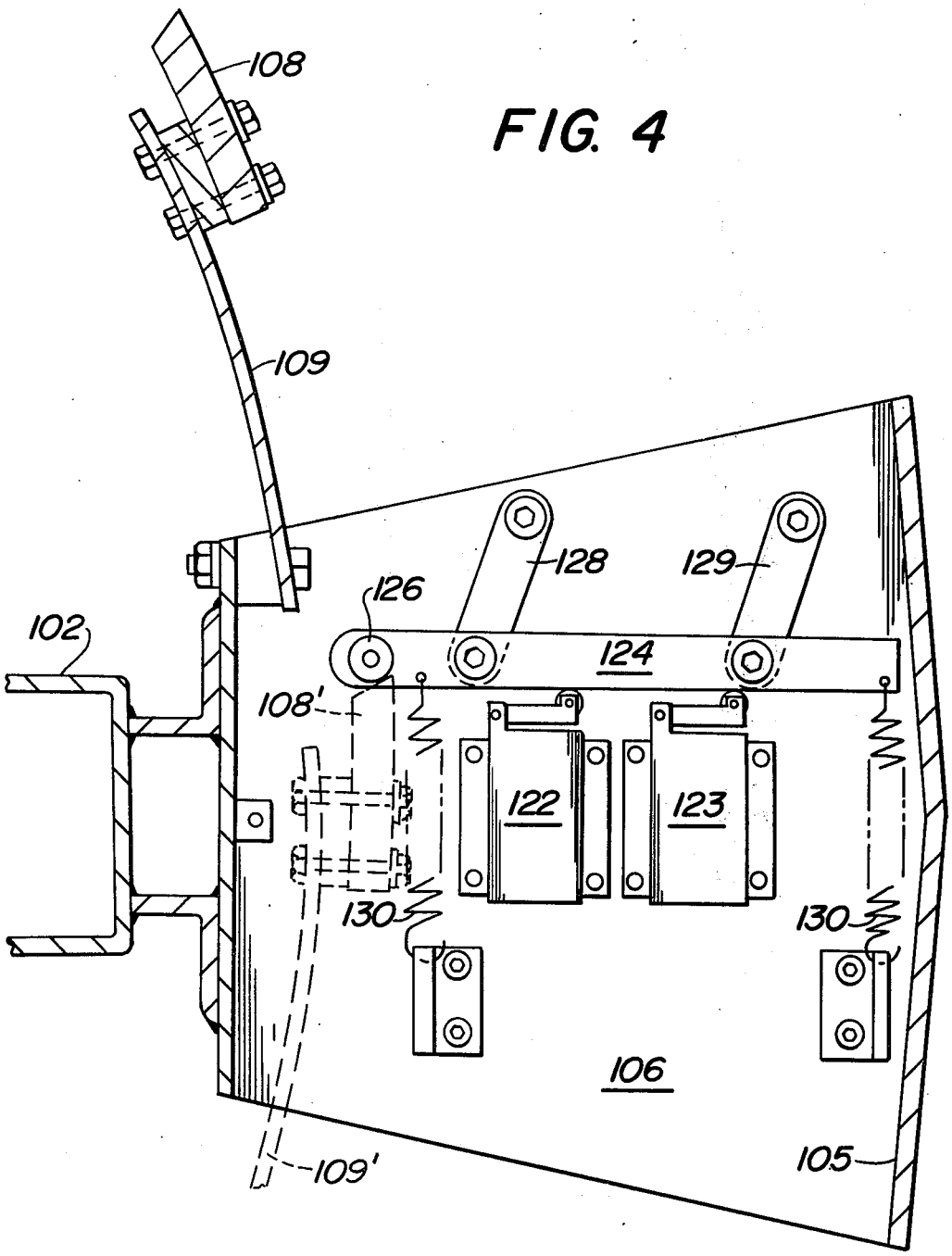
FIG. 4 is a sectional view taken along the line 4—4 in FIG. 1 but on an enlarged scale.

Referring to FIGS. 1, 3 and 4, carriage 12 is provided with a drive interrupter to initially slow down carriage 12 and thereafter stop carriage 12 in the event that it is about to collide with carriage 14. Carriage 12 is provided with a vertical post 102, corresponding to post 62 of carriage 16. Post 102 supports a generally channel-shaped frame 100 having a bottom wall 104 connected to a top wall 106 by a vertical wall 105. Extending in a trailing direction from the interrupter 98, there is provided a stop cam 108 and a slow cam 110 mounted one above the other on common support 109. The cams 108 and 110 are thereby at different elevations.

In FIG. 3, cam 108 has been cut away to show cam 110 and the valves operated thereby. In FIG. 4, cam 108 has been cut away to show cam 108 and the valves operated thereby.

The bottom wall 104 supports quick acting valves 112, 113 which are controlled by a transversely disposed link 114 of a parallelogram. Link 114 is biased toward the valves 112, 113 by springs 116. Link 114 moves horizontally by way of links 118, 119 pivoted to the bottom wall 104. Link 114 supports a cam follower 120.

Referring to FIG. 4 which is a view looking upwardly toward the bottom surface of top wall 106, wall 106 supports quick acting valves 122, 123 controlled by link 124. Link 124 supports a cam follower 126 at the elevation of stop cam 108. Link 124 is pivotably connected to links 128, 129 which in turn are pivotably connected to the top wall 106. Springs 130 bias the link 124 to a position wherein it actuates the valves 122, 123.

Referring again to FIGS. 3 and 4, the cams on carriage 14 corresponding to cams 108, 110 are designated 108' and 110' respectively. In the event that carriage 12 approaches carriage 14, cam 110' on support 109' at the trailing end of carriage 14 contacts cam follower 120 and moves the link 114 to the phantom position shown in FIG. 3 thereby actuating the valves 112, 113. As will be explained in detail hereinafter, actuation of valves 112, 113 will slow down the movement of carriage 12. If such slowing down of carriage 12 does not avoid a collision with carriage 14, the continued movement of carriage 12 will cause cam 108' on carriage 14 to contact the cam follower 126 and move the link 124 to a position wherein valves 122, 123 will be actuated. As will be explained hereinafter, the actuation of valves 122, 123 will cause carriage 12 to stop thereby avoiding a collision with carriage 14.

Referring to FIGS. 1 and 9, an annular plate 132 is supported from the base 36 by legs 138. Referring to FIGS. 7 and 9, arcuate cams 134 and 136 are adjustably connected to the upper edge of plate 132 so as to be generally diametrically opposite one another. Cams 134 and 136 by deactuating valves 146, 148 slow down the carriage which is moving counterclockwise in FIG. 9 and enable a servo valve 168 to be described hereinafter. A stop member 135 is provided at the ladle fill position. Member 135 is hydraulically actuated downwardly to an inactive position and spring biased upwardly to a carriage stop position. Member 135 causes the carriage to stop at the fill position by deflecting the sensing paddle 200 when the servo valve 168 is enabled by cam 134 so that a ladle may be refilled by vessel 32.

Cam 136 is adjacent the pour position for the ladles and defines the pouring zone. The function of cam 136 will be described later. Four housings 140 containing a plurality of magnetically actuatable switches are supported by annular plate 132 adjacent the lower edge thereof and radially inwardly of plate 132. See FIGS. 7 and 9. A magnet holder 142, of a non-magnetic material, is supported on the lower surface of panel 144 which moves with the carriage 12. Holder 142 supports a plurality of magnets each adapted to actuate one of the switches in housing 140 as holder 142 passes by the housing 140. The magnets in the various holders 142 are positioned differently so that the switches in housing 140 can generate a signal which identifies the specific carriage.

As shown more clearly in FIG. 8, the bottom surface of panel 144 supports parallel valves 146 and 148 which are deactuatable by cams 134 and 138 through follower 156 and cam 155 affixed to the preceding carriage through follower 158 when the carriage is in the pouring or filling position. A link 150 is pivotably connected to the panel 144 by links 152, 154. Link 150 is provided with cam followers 156, 158. The bias of springs 160 is overcome by follower 156 contacting the cam 134 or 136. A support 162 is connected to the link 150 and is movable therewith. Support 162 is provided with a plurality of permanent magnets 164.

As shown more clearly in FIGS. 1 and 7, a housing 166 is disposed on the carriage 12 above the panel 144. Within housing 166, there is provided a proportional servo control tracking valve 168. See FIG. 5. A lever arm 170 is pivotably connected to the top wall of housing 166 at pivot 171. Spring 172 biases the lever arm 170 to a position wherein valve 168 is in a fully clutched position. A cable 174 has one end anchored to pull against the lever arm 170 while being kept taut by spring 173. Lever arm 170 has a plurality of holes to facilitate connecting the cable 174 thereto at a variety of different locations spaced from the pivot 171.

Follower 158 is actuated by cam 155 on the trailing end of the next carriage as the two carriages contact each other to deactuate valves 146, 148 to slow down the carriage and to enable valve 168. At the same time, follower 158 causes movement of link 150 radially inward (to the left in FIG. 8) whereby magnets 164 close contacts 159 and/or 161 to initiate pouring of the ladle.

Housing 166 has an extension 176 which is generally horizontally disposed and extends in a trailing direction. Within extension 176 there is provided a horizontally disposed pulley 178 and a vertically disposed pulley 180. Cable 174 extends around pulley 178, around pulley 180 and then vertically upwardly through the vertical leg 182. See the lower righthand corner of FIG. 1. At the upper end of leg 182, there is provided a horizontally disposed and outwardly extending leg 184.

The leg 184 contains a vertically disposed pulley 186 around which the cable 174 extends at the junction of legs 182, 184. The cable 174 extends horizontally to a pulley 188. See FIG. 6. The pulley 188 is supported for adjustable movement along slots 190 in a top wall of housing 192. A suitable nut and bolt is provided to secure the housing 192 in the proper position for attaining the correct distance between sensing tip 202 and pouring spout S which corresponds to the distance between the edge of the mold flask and the mold pouring cup.

Figures 5, 6:
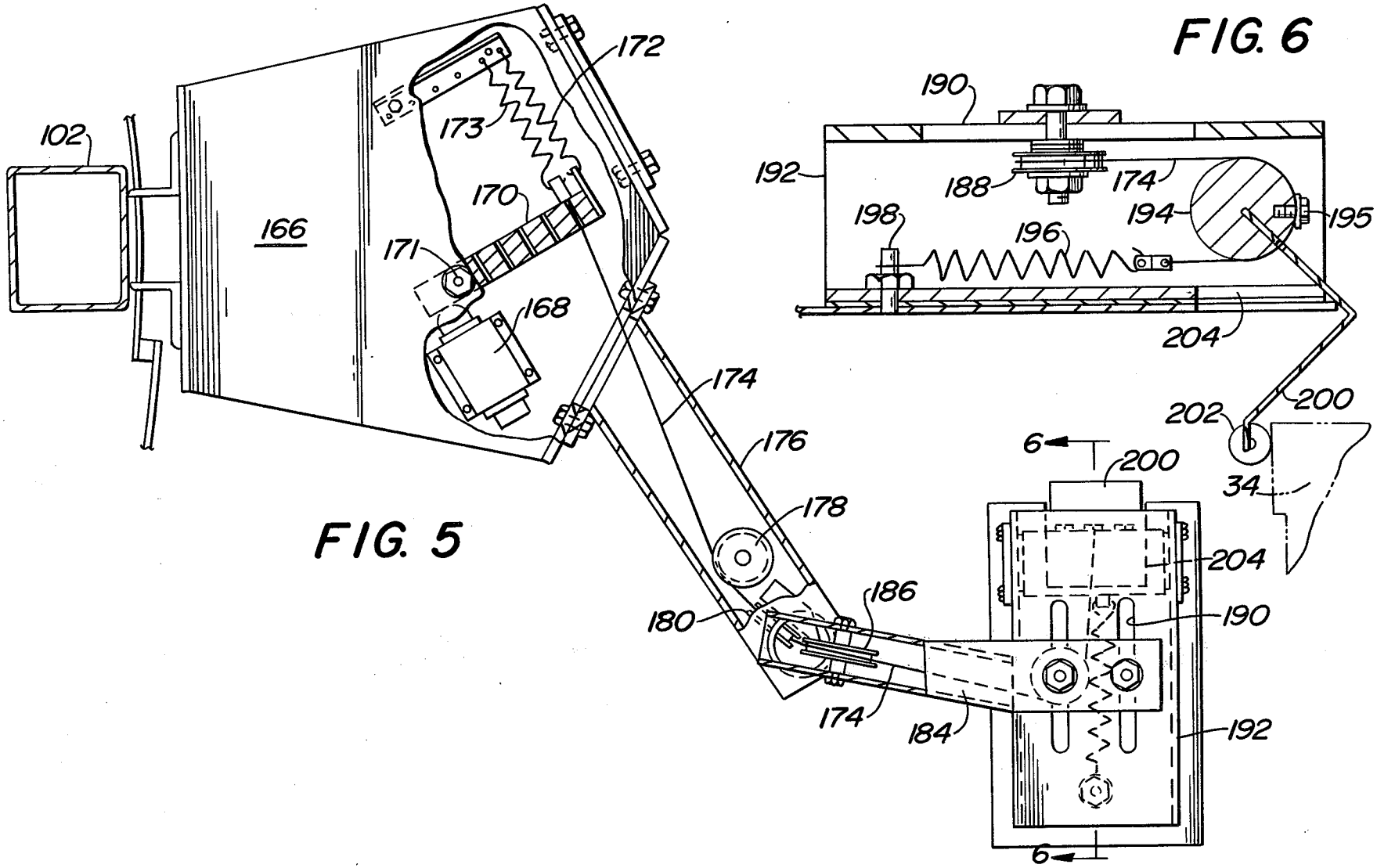
FIG. 5 is a sectional view taken along the line 5—5 in FIG. 1 but on an enlarged scale.
FIG. 6 is a sectional view taken along the line 6—6 in FIG. 5.

The housing 192 is horizontally disposed and open ended. A roller 194 is rotatably supported adjacent one end of the housing 192. The cable 174 extends around the roller 194 and is fixedly connected thereto by bolt 195. At its terminal end, the cable is connected to one end of spring 196 adjusted to provide a flexible stop. Spring 196 has its other end connected to the housing 192 at anchor 198. A sensing paddle 200 is fixedly connected at one end to the roller 194. Paddle 200 has a hole through which the cable 174 extends. The paddle is generally L-shaped in section as shown in FIG. 6 and terminates in a sensing tip 202. The portion of the bottom wall of housing 192 adjacent the paddle 200 is provided with a slot 204.

Figure 10:
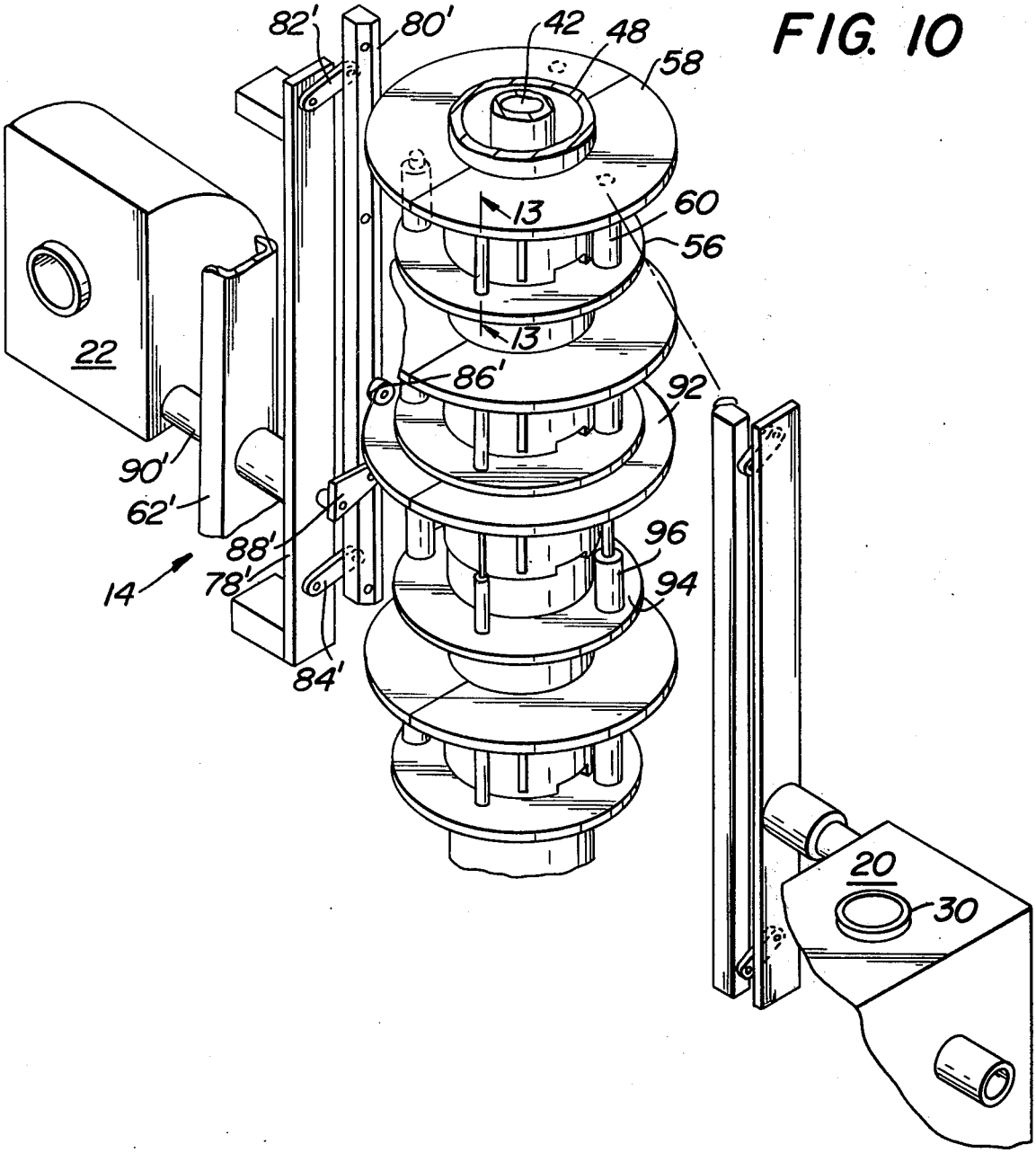
FIG. 10 is a partial perspective exploded view showing two carriages in part and a central column in part.
Figure 13:
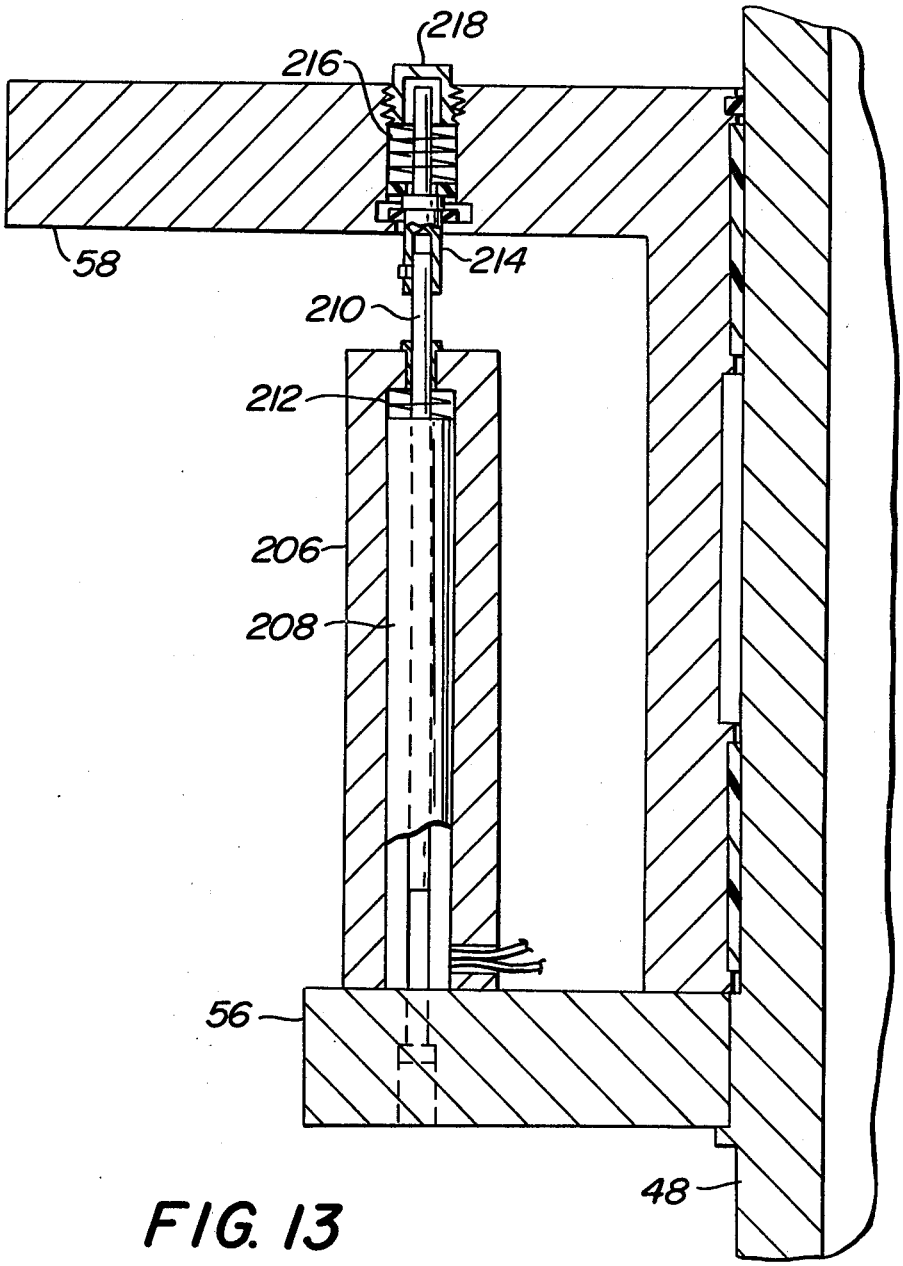
FIG. 13 is a sectional view taken along the line 13—13 in FIG. 10 but on an enlarged scale.

Referring to FIGS. 10 and 13, there is shown in FIG. 13 a linear transducer assembly extending between the fixed plate 56 and the movable cam plate 58. A similar assembly is provided between each of the fixed plates and cam plates on the center column 48. Each assembly includes a transducer housing 206 supported by the fixed plate and within which is disposed a linear transducer 208. Transducer 208 is biased downwardly by spring 212.

The transducer 208 is provided with a movable core rod 210. Rod 210 extends upwardly through the upper end of the housing 206 and is connected to one end of connecting rod 214. Connecting rod 214 extends through a thrust bearing supported by the cam plate 58. Above the bearing, the connecting rod 214 is provided with a shoulder biased downwardly by spring 216. Spring 216 is provided with a retainer 218 threadedly connected to the cam plate 58. As cam plate 58 moves upwardly by its cylinder 60, the transducer assembly generates a signal which will be described in connection with FIG. 15.

Referring to FIG. 1, a gas supply conduit 230 is connected to the interior of the hollow drive shaft 42. At the upper end of the drive shaft 42, there is provided a distributor 232 supported by way of a pipe swivel on the upper end of drive shaft 42. From the distributor 232, a plurality of flexible conduits 234 extend radially outwardly each to the vertical post of one of the carriages. Each conduit 234 extends downwardly along the post of its carriage to conduit 236 supported by the ladle. The ladle is preferably provided internally with a refractory lining and a burner nozzle 238. Thus, combustible gas is supplied to each of the ladles on each of the carriages to maintain the temperature of the ladle refractory at the desired elevation. Hence, if the mold line stops due to a malfunction, the ladle refractory is maintained at the proper temperature by the heat from the burner nozzle 238 until the malfunction is corrected.

The vertical post on each carriage is hollow and forms therein a hydraulic tank 240. See the schematic hydraulic diagram shown in FIGS. 14A and 14B. The description in said figures is orientated with respect to the carriage 12. Brake pump 74' on carriage 12 has its inlet connected to the tank 240 by way of a filter 242. Pump 74' is provided with a manually operable by-pass valve 244. The outlet side of pump 74' is connected to conduit 246 which extends to valve 123 which is part of the upper hydraulic valving. Valve 123 is a stop valve for stopping the carriage 12 and is shown in FIG. 4.

Valve 123 is connected to a slow speed valve 112 by way of conduit 249. Conduit 252 interconnects valve 112 with slow speed valve 146 forming a part of the lower hydraulic valving. The slow speed valve 146 is interconnected with the mold tracking activation valve 148 via conduit 276. A conduit 258 has one end connected to valve 146, and is connected to slow speed valve 113. Conduit 260 connects valve 113 to tank 240 via a check valve and filter.

The clutch pump 70' has its inlet connected to tank 240 by way of a filter. The outlet from pump 70' is connected by way of conduit 264 to valve 168 which functions as a mold tracking valve 168. The valve 168 is controlled by contact between paddle tip 202 and a mold 34.

A conduit 270 extends from valve 168 to valve 148 which is connected to conduit 278. Conduit 274 extends from valve 168 to a junction with one portion being connected to valve 148 and the other portion being connected to conduit 276 which connects to conduit 254. The opposite end of conduit 254 is connected to conduit 249 via a flow control valve. Stop valve 122 is connected to conduit 278. Conduit 290 is connected to a junction in conduit 246 at valve 123 at one end and its opposite end is connected to the inlet of back pressure regulator 256. Conduit 288 is connected to valve 113 at one end and is connected to an adjustable flow control valve 296. Conduit 292 connects to the opposite side of flow control valve 296 and is connected to valve 122 and the inlet of back pressure regulator 266. The outlets of back pressure regulators 256 and 266 are connected to tank 240 via conduit 294.

The interaction of clutch pump 70', brake pump 74', their respective pinions and valve 168 is shown in simplified form in FIG. 16. When valves 146 and 148 are deactuated by cams 134, 136 or 155, the carriage is driven by gear 44. Pump 74' is circulating fluid with no back pressure as shown in FIG. 16. Pump 70' has maximum back pressure. As valve 168 moves from the position shown in FIG. 16, a neutral position is reached where both pumps are circulating fluid freely. As valve 168 continues, pump 70' circulates fluid freely and pump 74' eventually reaches a position of maximum back prssure at which point pinion 68' is free wheeling and pump 74' acts as a brake to stop the carriage.

As described above, clutch pump 70' is connected by pinion 68' to the ring gear 44 which is driven by the motor 38. Brake pump 74' is connected by way of pinion 72' to the stationary ring gear 46. The intermittent and alternate operation of the pumps 70' and 74' controls the rate of movement of the carriage 12. When back pressure builds up in either conduit 246 or conduit 264, the respective pump 74' or 70' starts to resist free motion. This causes pump 70' to act like a clutch so that there is driving motion between ring gear 44 and the carriage 12. Also, pump 74' in response to back pressure behaves like a brake whereby the carriage is slowed down due to the braking action between pinion 72' and the stationary gear 46.

When the paddle tip 202 is not contacting one of the molds 34, the spring associated with valve 168 causes it to assume a position opposite to that shown in FIG. 14B and in such opposition position, pump 74' circulates a hydraulic fluid such as oil through valve 168 without any back pressure by way of conduits 246, 254, 276, 274, 270, and 278. Valves 146 and 148 will be in the position shown in FIG. 14B when cam follower 156 or 158 are engaged by cams 134, 136 or 155. While pump 74' is circulating a hydraulic fluid without any back pressure, pump 70' is subjected to considerable back pressure in conduit 264 due to the position of valve 168. Since the output of pump 70' is subjected to considerable back pressure, it cannot permit pinion 68' to turn whereby the latter is driven at the speed of gear 44.

When the sensing paddle tip 202 contacts a mold 34, it pivots thereby applying tension to cable 174 which in turn pivots lever 170 to control valve 168 so that it assumes the position shown in FIG. 14B. Pump 74' then starts to act as a brake to slow the carriage speed. The clutching and braking action is smooth and continuous. If the mold 34 begins to travel faster than the carriage 12, the tracking valve 168 then adjusts to release the brake pump and engages the clutch pump to the degree required to exactly match the speeds. There is thusly described a self-correcting, closed loop servo control system which functions with negligible force applied to the mold 34. The system can cause the carriage to accelerate to maximum speed or come to a smooth stop in only a few inches of travel. Back pressure regulators 256 and 266 are adjusted to limit the maximum clutch and braking forces applied.

Referring to FIG. 15, the rate at which hydraulic fluid is transmitted to a cylinder for effecting a pouring of molten metal in a mold 34 is controlled by a servo valve 282. Servo valve 282 is responsive to a tracer 284 which follows the curve of a pouring rate cam 286 and is responsive to transducer 208 which tells the servo valve 282 where the cam plate 58 is presently located which in turn is a direct function of the rotative position of the ladle such as ladle 20. Cam 286, tracer 284 and servo valve 282 are located in any convenient location at a console remote from the environment of apparatus 10. The function of cam 286 and tracer 284 may be accomplished electronically in a manner known to those skilled in the art.

In view of the above description, the drawings attached hereto and the state of the art reflected by said U.S. Pat. No. 3,977,461, the following brief description of operation is deemed adequate.

When a mold car enters the pouring zone at location X in FIG. 9, it must be "qualified" for pouring, that is:

a. it must be far enough into the pouring zone to be completed should the mold line unexpectedly stop;

b. the mold car must be carrying a mold 34;

c. the mold 34 cannot have been previously designated a "bad mold" by a molding machine operator who entered this information into a shift register.

If the new mold car meets all of the above qualifications, the vessel 32 automatically dispenses a predetermined quantity of molten metal into a waiting ladle at the fill station. Post inoculant material may be metered into the ladle with the metal stream at this point or may be dispensed directly into the unfilled ladle at the prefill station 137 (FIG. 2) which is adjacent to the fill station. When the ladle is filled, the ladle is released by lowering the release cylinder of member 135.

After receiving an accurate predetermined quantity of molten metal, the carriage is driven at high speed to the pouring zone YZ by motor 38, gear 44, and pinion 68. When cam follower 158 is activated by the preceding carriage cam 155 and tip 202 contacts mold 34 as shown in FIG. 6, the carriage tracks the speed of the mold 34 as described above so that the spout S is aligned with the sprue cup of mold 34. A magnet in holder 142 trips a switch to identify the carriage to the console and a magnet 164 trips switch 159 and/or 161 to initiate a pour signal.

When the carriage identity and pour signal are received at the console, valve 282 directs hydraulic fluid to the appropriate pour actuator in direct proportion to the pour rate curve selected. A cam plate such as plate 58 is elevated to cause shaft 90 to rotate and pour the molten metal into the mold. The pouring rate is independent of the speed or position of the carriage so long as the carriage is in the pouring zone designated YX in FIG. 9.

When a carriage reaches the end of the pouring zone, the preceding carriage cam 155 has disengaged and cam 136 looses contact with cam follower 156. Springs 160 move link 150 to deactivate valves 146, 148, and thereby valve 168 whereby the carriage can move at a high speed to the filling station where it is slowed by cam 134 and then stopped by member 135. At the end of the pouring zone, one or more magnets in holder 142 will trip switches to identify the carriage to the console so that the servo valve 282 will permit fluid to bleed out of its associated pour actuator whereby the ladle will by gravity rotate back to its fill position.

The present invention may be embodied in other specific forms without departing from the spirit or essential attributes thereof and, accordingly, reference should be made to the appended claims, rather than to the foregoing specification as indicating the scope of the invention.

It is claimed:

1. A rotary pouring system comprising:

(a) a plurality of carriages each supporting a ladle rotatable from a fill position to a pour position,
(b) means for guiding said carriages in a closed loop having a loading zone where ladles are filled and a pouring zone where ladles are rotated to a pour position,
(c) a common drive means for said carriages,
(d) a sensor means supported by each carriage for sensing the presence of a mold and causing the carriage to attain a mold tracking speed, a clutch means and a brake means on each carriage selectively coupled to said common drive means and controlled by said sensor means.

2. A system in accordance with claim 1 wherein each ladle is provided with a burner nozzle and fuel supply means for maintaining an elevated temperature in the ladle.

3. A system in accordance with claim 1 wherein each carriage includes a hollow frame and contains a hydraulic fluid tank, each of said brake means and clutch means being coupled by hydraulic circuitry including a mold tracking valve to said tank.

4. A system in accordance with claim 1 including a discrete parallelogram linkage on each carriage, each of said linkages being connected to its respective ladle for rotating its associated ladle about a horizontal axis to effect a pouring of molten metal from the ladle.

5. A system in accordance with claim 4 including an actuator centrally located with respect to said loop for selectively actuating each parallelogram linkage.

6. A system in accordance with claim 1 including means for continuously varying the pouring rate of the ladles at the pouring zone.

7. A system in accordance with claim 6 wherein said last-mentioned means includes a sensor associated with each carriage for sensing the then existing rotative position of the respective ladles.

8. A system in accordance with claim 1 wherein said common drive means includes a hollow vertically disposed drive shaft, said hollow drive shaft forming part of a gas supply means for supplying gas to a burner nozzle on each of the ladles.

9. A rotary pouring system comprising:
(a) a plurality of carriages each supporting a ladle rotatable from a fill position to a pour position, each ladle being provided with a burner nozzle and fuel supply means for maintaining an elevated temperature in the ladle,
(b) means for guiding said carriages in a closed loop having a loading zone where ladles are filled and a pouring zone where ladles are rotated to a pour position,
(c) a discrete linkage on each carriage, each of said linkages being connected to its respective ladle for rotating its associated ladle about a horizontal axis to effect a pouring of molten metal from the ladle, a discrete actuator having a vertically directed actuation force for each linkage,
(d) a sensor means supported by each carriage for sensing the presence of a mold and causing the carriage to match the mold speed,
(e) means for continuously varying the pouring rate of the ladles at the pouring zone.

10. A system in accordance with claim 9 wherein said last-mentioned means includes a discrete sensor associated with each carriage for sensing the then existing rotative position of the respective ladles.

11. A system in accordance with claim 9 including a single common drive motor for moving said carriages, a centrally disposed upright drive shaft driven by said motor, a gear driven by said shaft, each carriage including a pinion meshed with said gear, and means for selectively declutching the driving effect of each pinion.

12. A system in accordance with claim 11 including a stationary gear coaxial with said driven gear, each carriage having a pinion meshed with said stationary gear and an associated brake means for braking rotation of the last-mentioned pinion.

13. A system in accordance with claim 9 wherein the last-mentioned means includes a discrete pour actuator for each carriage, said pour actuators being coaxial and disposed one above the other centrally within said loop.

14. A system in accordance with claim 9 wherein said last-mentioned means includes means remote from said carriages and which defines the pouring rate whereby the pouring rate can be rapidly changed.

15. A system in accordance with claim 1 wherein said common drive means includes a drive motor for moving said carriages, a centrally disposed upright drive shaft driven by said motor, a gear driven by said shaft, each carriage including a pinion meshed with said gear, and means for selectively declutching the driving effect of each pinion.

16. A rotary pouring system comprising:
(a) a plurality of carriages each supporting a ladle rotatable from a filled position to a pour position,
(b) means for guiding said carriages in a closed loop having a loading zone where ladles are filled and a pouring zone where ladles are rotated to a pour position,
(c) a common drive means for said carriages including a single common drive motor, a centrally disposed upright drive shaft driven by said motor, a gear driven by said shaft, each carriage including a pinion meshed with said gear,
(d) a sensor means supported by each carriage for sensing the presence of a mold and causing the carriage to attain a mold tracking speed, and a clutch means on each carriage and controlled by said sensor means for selectively coupling each pinion to said gear.

* * * * *